US012484719B1

(12) United States Patent
Smith

(10) Patent No.: US 12,484,719 B1
(45) Date of Patent: Dec. 2, 2025

(54) MATTRESS COVER AND METHODS OF USE

(71) Applicant: Donald W. Smith, Birmingham, AL (US)

(72) Inventor: Donald W. Smith, Birmingham, AL (US)

( * ) Notice: Subject to any disclaimer, the term of this patent is extended or adjusted under 35 U.S.C. 154(b) by 43 days.

(21) Appl. No.: 18/772,458

(22) Filed: Jul. 15, 2024

(51) Int. Cl.
*A47G 9/02* (2006.01)

(52) U.S. Cl.
CPC .... *A47G 9/0238* (2013.01); *A47G 2009/0276* (2013.01)

(58) Field of Classification Search
CPC ..... A47G 9/0238; A47G 2009/0276; A47G 9/0246; A47G 9/0929
USPC ..... D6/602
See application file for complete search history.

(56) References Cited

U.S. PATENT DOCUMENTS 2,272,229 A * 2/1942 Tucker ..... D06H 1/00 139/420 R
5,655,236 A 8/1997 Murray
5,809,593 A * 9/1998 Edwards ..... A47G 9/0246 5/482
D624,345 S * 9/2010 Diaz, Jr. ..... D6/602
8,875,326 B1 * 11/2014 Bernath ..... A47G 9/0246 5/907
10,881,224 B2 1/2021 Carr
2005/0132493 A1 * 6/2005 Lauderman ..... D03D 15/283 5/482
2011/0302717 A1 * 12/2011 Campasano ..... A47G 9/0238 112/475.01
2012/0060283 A1 * 3/2012 Campasano ..... A47G 9/0238 5/495
2016/0022062 A1 * 1/2016 Carr ..... B41M 1/12 5/497
2021/0212481 A1 * 7/2021 Anderson ..... A47G 9/0238
2023/0200571 A1 6/2023 Polisson, III et al.
2024/0156286 A1 * 5/2024 Pratola ..... A47G 9/0246
2024/0285106 A1 * 8/2024 McTaggart ..... A47G 9/02
2025/0151933 A1 * 5/2025 Johnston ..... A47G 9/04

FOREIGN PATENT DOCUMENTS

WO 2010003189 1/2010
WO 2014128695 8/2014

* cited by examiner

*Primary Examiner* — Eric J Kurilla
(74) *Attorney, Agent, or Firm* — AdamsIP, LLC; Kenneth M. Bush

(57) ABSTRACT

A mattress cover, as disclosed herein, comprises a top panel, a skirt, and an elastic band affixed to the skirt bottom end. A first indicator is embossed on the top panel exterior surface to indicate the size and orientation of the cover. A second indicator is imprinted on the elastic band exterior surface to indicate the size of the cover. A third indicator is affixed to the top panel exterior surface to indicate the size and orientation of the cover. At least one of the indicators is preferably color coded to further indicate the mattress cover size. The mattress cover promotes expedited sorting of different sizes of mattress covers in commercial laundering facilities, thus increasing efficiency and productivity. Related methods are disclosed.

17 Claims, 2 Drawing Sheets

MATTRESS COVER AND METHODS OF USE

FIELD OF THE INVENTION

This disclosure relates to mattress covers having features that promote expedited sorting of different sizes of mattress covers in commercial laundering facilities, and related methods of use.

BACKGROUND OF THE INVENTION

Hotels, particularly hotels at large vacation destinations, may have hundreds or thousands of hotel rooms, each having at least one bed. The volume of bed linens that is laundered daily can be enormous, particularly during busy seasons. During the laundering process, used bed linens (a.k.a. dirty or soiled) are typically sorted based on size (e.g. King, Queen, Full, Twin) prior to washing. For example, at some large laundering facilities, dirty laundry is continuously conveyed on a conveyor belt passing in front of a plurality of laundry receptacles for receiving different sized bed linens. Service workers sort the laundry and place the sorted items into the appropriate laundry receptacles. This requires that laundry items be identified quickly so that the conveyor does not need to be paused. A problem with used bed linens is that they are typically wadded up and are the same or similar color, thus making it difficult to quickly identify the size or find the size identification tags. Accordingly, there is a need for improved apparatus and methods for quickly sorting bed linens to expedite the laundry process.

BRIEF SUMMARY OF THE INVENTION

These and other needs may be overcome by the apparatus and methods disclosed herein. Additional improvements and advantages may be recognized by those of ordinary skill in the art upon study of the present disclosure.

The present disclosure is directed to mattress covers and related methods of use. In an exemplary implementation disclosed herein, a mattress cover comprises a substantially rectangular top panel having an exterior surface, a side panel or skirt, and an elastic band, in various aspects. The skirt top end is continuous with or continuously affixed to the top panel along the entire perimeter of the top panel. The elastic band top end is preferably continuously affixed to the skirt bottom end along the entire length of the skirt bottom end.

A first indicator is preferably embossed on the top panel exterior surface to indicate the size and orientation of the cover. The first indicator is preferably a single word, such as "KING", that is repeatedly embossed along the entire top panel exterior surface. A second indicator is preferably imprinted on the elastic band exterior surface to indicate the size of the cover. The second indicator is preferably a single word, such as "KING", that is repeatedly imprinted along the entire length of the elastic band exterior surface. A third indicator is preferably affixed to the top panel exterior surface to indicate the size and orientation of the cover. The third indicator is preferably a single letter, such as "K", that is preferably affixed adjacent to at least one corner of the top panel exterior surface. At least one of the indicators is preferably color coded to further indicate the mattress cover size.

The mattress covers, as disclosed herein, facilitate the service workers in quickly identifying the size of the mattress covers so that they can be removed from an actively moving conveyor carrying dirty laundry and quickly sorted into the appropriately designated receptacles. This significantly increases efficiency and productivity, resulting in reduced labor costs. In addition, by having size and orientation indicators, this allows hotel service workers (e.g. maids) to quickly and accurately identify the correct mattress cover size for making a bed and to quickly make the bed, again increasing efficiency and productivity. This also avoids a common problem where the wrong size mattress cover is pulled from a housekeeping cart, unfolded to use and discovered to be the wrong size, and then combined with dirty laundry to be washed even though it is still clean.

This summary is presented to provide a basic understanding of some aspects of the apparatus and methods disclosed herein as a prelude to the detailed description that follows below. Accordingly, this summary is not intended to identify key elements of the apparatus or methods disclosed herein or to delineate the scope thereof.

Figure 1:
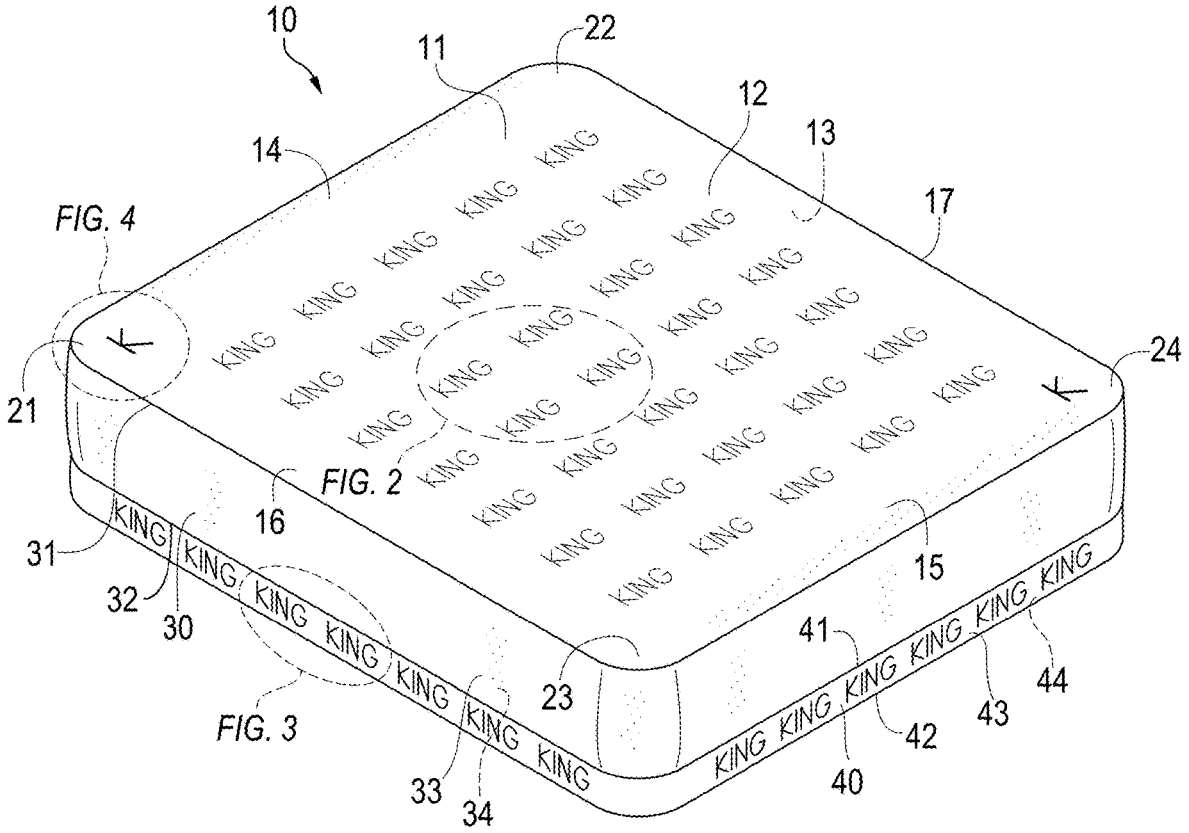
FIG. 1 illustrates by top perspective view an exemplary implementation of a mattress cover.
Figure 2:
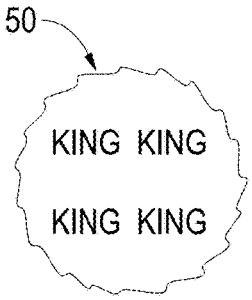
FIG. 2 illustrates by top plan view an exemplary portion of the top panel exterior surface of the mattress cover of FIG. 1.
Figure 3:
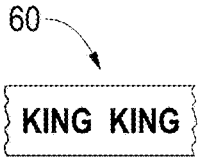
FIG. 3 illustrates by side elevation view an exemplary portion of the elastic band exterior surface of the mattress cover of FIG. 1.
Figure 4:
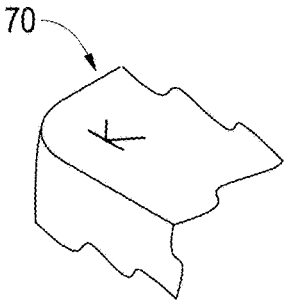
FIG. 4 illustrates by top plan view an exemplary corner of the top panel exterior surface of the mattress cover of FIG. 1.

The Figures are exemplary only, and the implementations illustrated therein are selected to facilitate explanation. Where used in the various Figures, the same numerals designate the same or similar elements. Furthermore, when the terms "top," "bottom," "right," "left," "forward," "rear," "first," "second," "interior," "exterior," and similar terms are used, the terms should be understood in reference to the orientation of the implementations shown in the drawings and are utilized to facilitate description thereof. Use herein of relative terms such as generally, about, approximately, essentially, may be indicative of engineering, manufacturing, or scientific tolerances, or other such tolerances, as would be readily recognized by those of ordinary skill in the art upon study of this disclosure.

DETAILED DESCRIPTION OF THE INVENTION

The present disclosure is directed to mattress covers and related methods of use, exemplary implementations of which are shown in FIGS. 1-5. As used herein, "mattress cover(s)" refers to fitted bed sheets, fitted mattress pads, and similar items.

In an exemplary implementation, a mattress cover 10 comprises a substantially rectangular top panel 11 having an exterior surface 12, an interior surface 13, an upper end 14, a lower end 15, a left side 16, and a right side 17, in various aspects. An upper left corner 21 is formed at a junction between the top panel upper end 14 and the top panel left side 16, an upper right corner 22 is formed at a junction between the top panel upper end 14 and the top panel right side 17, a lower left corner 23 is formed at the junction between the top panel lower end 15 and the top panel left side 16, and a lower right corner 24 is formed at the junction between the top panel lower end 15 and the top panel right side 17, in various aspects. The top panel 11 is formed from one or more flexible fabrics, as is known in the art.

The mattress cover 10 further comprises a side panel or skirt 30 having a top end 31, a bottom end 32, an exterior surface 33, and an interior surface 34, in various aspects. The skirt top end 31 is continuous with or continuously affixed to the top panel 11 along the entire perimeter of the top panel 11. The skirt 30 is formed from one or more flexible fabrics, as is known in the art.

The mattress cover 10 further comprises an elastic band 40 having a top end 41, a bottom end 42, an exterior surface 43, and an interior surface 44, in various aspects. The elastic band top end 41 is preferably continuously affixed to the skirt bottom end 32 along the entire length of the skirt bottom end 32. The elastic band 40 is formed from a flexible elastic material, as is known in the art.

The mattress cover 10 is designed such that the top panel 11 covers the top of a mattress (not shown), the side panel or skirt 30 covers the sides of a mattress, and the elastic band 40 is positioned on the bottom of a mattress proximate the mattress sides to reversibly secure the mattress cover 10 to the mattress, as is commonly known. The mattress cover 10 may be sized to fit any mattress sizes, such as King, Queen, Full (Double), or Twin, as is known in the art.

A first indicator 50 is preferably embossed on the top panel exterior surface 12 to indicate the size and orientation of the cover 10, in various aspects. The first indicator 50 is preferably a single word that is repeatedly embossed along the entire top panel exterior surface. For example, the first indicator 50 may be a single word selected from a group of words indicating mattress size, such as "KING", "QUEEN", "FULL", or "TWIN" (see FIG. 2). Other terms or non-English equivalents can be used.

A second indicator 60 is preferably imprinted on the elastic band exterior surface 43 to indicate the size of the cover 10, in various aspects. The second indicator 60 is preferably a single word that is repeatedly imprinted along the entire length of the elastic band exterior surface 43. For example, the second indicator 60 may be a single word selected from a group of words indicating mattress size, such as "KING", "QUEEN", "FULL", or "TWIN" (see FIG. 3). Other terms or non-English equivalents can be used.

A third indicator 70 is preferably affixed to the top panel exterior surface 12 to indicate the size and orientation of the cover, in various aspects. The third indicator 70 is affixed adjacent to at least one corner of the top panel exterior surface 12, and more preferably to two opposing corners, such as the upper left corner 21 and the lower right corner 24 or the upper right corner 22 and the lower left corner 23. Alternately, the third indicator 70 may be affixed adjacent each of the corners 21, 22, 23, 24. The third indicator 70 is preferably a single letter selected from a group of letters indicating mattress size, such as "K", "Q", "F", or "T" (see FIG. 4). Other letters or non-English equivalents can be used.

At least one of the indicators 50, 60, 70 is preferably color coded to further indicate the mattress size, in various aspects. For example, the second indicator 60 and the third indicator 70 may be color coded to indicate the size of the cover. The color codes may be selected from a group of colors, such as red, blue, green, and gray, wherein red indicates King size, blue indicates Queen size, green indicates Full size, and gray indicates Twin size.

Figure 5:
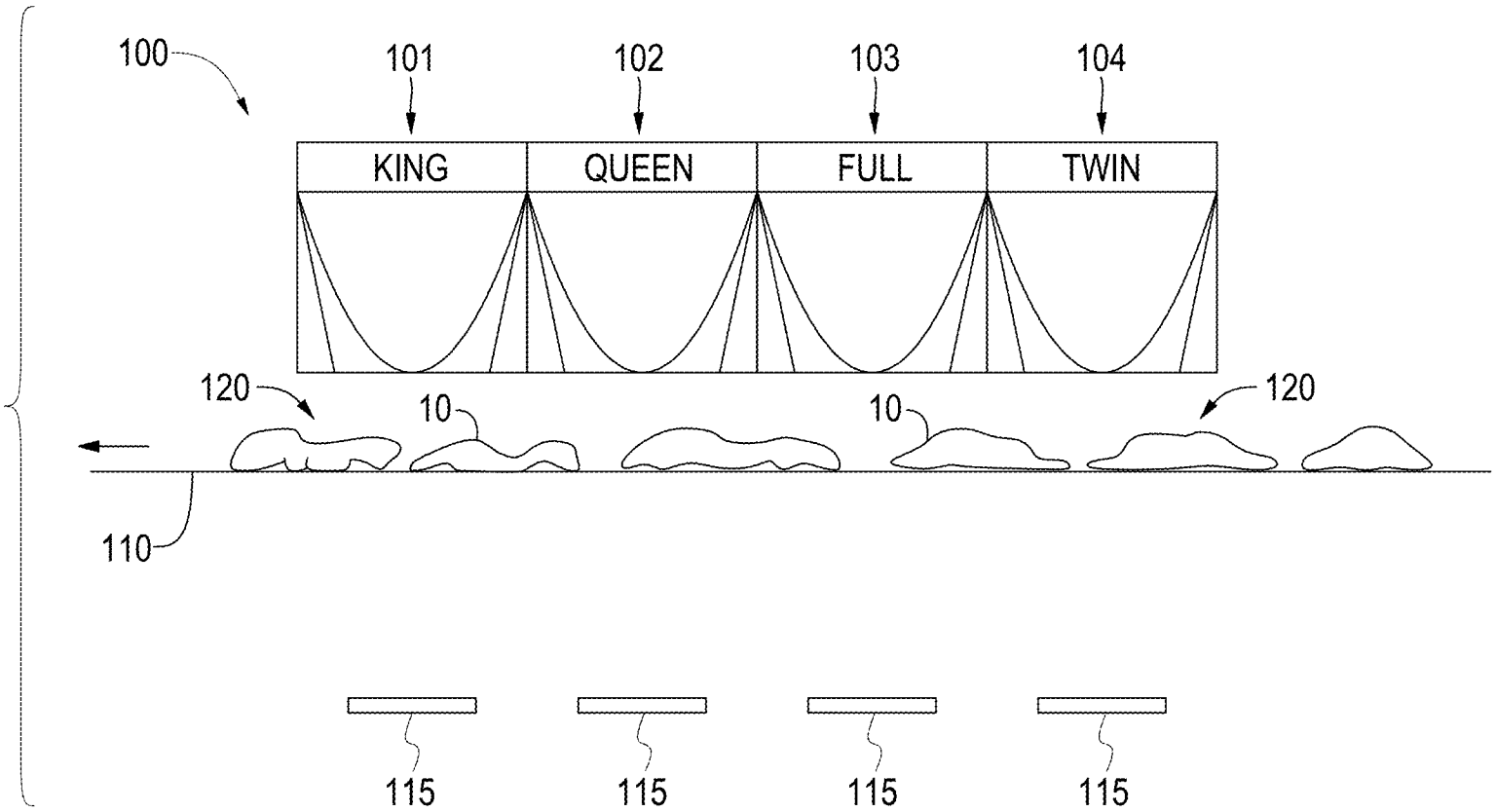
FIG. 5 illustrates by schematic view an exemplary implementation of a laundry sorting station.

FIG. 5 illustrates an exemplary implementation of a laundry sorting station 100 comprising a plurality of laundry receptacles 101, 102, 103, 104 for receiving sorted dirty laundry, in various aspects. A conveyor 110 is located between the laundry receptacles and a plurality of service worker stations 115, in various aspects. The conveyor 110 conveys dirty laundry 120, which includes various sizes of mattress covers 10, pass the laundry receptacles 101, 102, 103, 104 and the worker stations 115. Service workers (not shown) positioned at the worker stations 115 sort the dirty laundry 120 and place the items in the appropriate receptacles 101, 102, 103, 104 as the dirty laundry 120 passes by.

During this sorting process, the workers may remove any King size mattress covers from the dirty laundry 120 using the first indicator 50, the second indicator 60, and/or the third indicator 70 and place them into a laundry receptacle for receiving King size mattress covers, such as receptacle 101. The workers may also remove any Queen size mattress covers from the dirty laundry 120 using the first indicator 50, the second indicator 60, and/or the third indicator 70 and place them into a laundry receptacle for receiving Queen size mattress covers, such as receptacle 102. The workers may also remove any Full size mattress covers from the dirty laundry 120 using the first indicator 50, the second indicator 60, and/or the third indicator 70 and place them into a laundry receptacle for receiving Full size mattress covers, such as receptacle 103. The workers may also remove any Twin size mattress covers from the dirty laundry 120 using the first indicator 50, the second indicator 60, and/or the third indicator 70 and place them into a laundry receptacle for receiving Twin size mattress covers, such as receptacle 104.

The indicators 50, 60, 70 facilitate the service workers in quickly identifying the size of the mattress covers 10 so that they can be removed from an actively moving conveyor carrying dirty laundry and quickly sorted into the appropriately designated receptacles, thus significantly increasing efficiency and productivity. In addition, the indicators 50, 60, 70 facilitate hotel service workers in quickly and accurately identifying the correct mattress cover size and orientation for quickly making a bed, again increasing efficiency and productivity.

The foregoing discussion along with the Figures discloses and describes various exemplary implementations. These implementations are not meant to limit the scope of coverage, but, instead, to assist in understanding the context of the language used in this specification and in the claims. The Abstract is presented to meet requirements of 37 C.F.R. § 1.72 (b) only. Accordingly, the Abstract is not intended to identify key elements of the apparatus and methods disclosed herein or to delineate the scope thereof. Upon study of this disclosure and the exemplary implementations herein, one of ordinary skill in the art may readily recognize that various changes, modifications and variations can be made thereto without departing from the spirit and scope of the inventions as described herein and as defined in the following claims.

The invention claimed is:

1. A cover for a mattress, comprising:

a. a rectangular top panel having an exterior surface, an upper end, a lower end, a left side, a right side, an upper left corner formed at a junction between the top panel upper end and the top panel left side, an upper right corner formed at a junction between the top panel upper end and the top panel right side, a lower left corner formed at the junction between the top panel lower end and the top panel left side, and a lower right corner formed at the junction between the top panel lower end and the top panel right side;

b. a skirt having a top end, a bottom end, and an exterior surface, wherein the skirt top end is continuously affixed to the top panel along the entire perimeter of the top panel;

c. an elastic band having a top end, a bottom end, and an exterior surface, wherein the elastic band top end is affixed to the skirt bottom end along the length of the skirt bottom end;

d. a first indicator embossed on the top panel exterior surface to indicate the size of the cover, wherein the first indicator is repeatedly embossed along the entire top panel exterior surface;

e. a second indicator imprinted on the elastic band exterior surface to indicate the size of the cover, wherein the second indicator is repeatedly imprinted along the entire length of the elastic band; and f. a third indicator affixed to the top panel exterior surface to indicate the size and orientation of the cover, wherein the third indicator is affixed adjacent to at least one corner of the top panel exterior surface.

2. A cover for a mattress according to claim 1, wherein the elastic band top end is continuously affixed to the skirt bottom end along the entire length of the skirt bottom end.

3. A cover for a mattress according to claim 1, wherein the first indicator is a single word selected from a group of words consisting of "KING", "QUEEN", "FULL", and "TWIN".

4. A cover for a mattress according to claim 1, wherein the second indicator is a single word selected from a group of words consisting of "KING", "QUEEN", "FULL", and "TWIN".

5. A cover for a mattress according to claim 1, wherein the third indicator is a single letter selected from a group of letters consisting of "K", "Q", "F", and "T".

6. A cover for a mattress according to claim 1, wherein the third indicator is affixed adjacent to the upper left corner and the lower right corner.

7. A cover for a mattress according to claim 1, wherein the second indicator and third indicator are color coded to indicate the size of the cover, wherein the color codes are selected from the group of colors consisting of red, blue, green, and gray, wherein red indicates King size, blue indicates Queen size, green indicates Full size, and gray indicates Twin size.

8. A cover for a mattress, comprising:

a. a rectangular top panel having an exterior surface, an upper end, a lower end, a left side, a right side, an upper left corner formed at a junction between the top panel upper end and the top panel left side, an upper right corner formed at a junction between the top panel upper end and the top panel right side, a lower left corner formed at the junction between the top panel lower end and the top panel left side, and a lower right corner formed at the junction between the top panel lower end and the top panel right side;

b. a skirt having a top end, a bottom end, and an exterior surface, wherein the skirt top end is continuously affixed to the top panel along the entire perimeter of the top panel;

c. an elastic band having a top end, a bottom end, and an exterior surface, wherein the elastic band top end is continuously affixed to the skirt bottom end along the entire length of the skirt bottom end;

d. a first indicator embossed on the top panel exterior surface to indicate the size and orientation of the cover, wherein the first indicator is repeatedly embossed along the entire top panel exterior surface, wherein the first indicator is a single word selected from a group of words consisting of "KING", "QUEEN", "FULL", and "TWIN";

e. a second indicator imprinted on the elastic band exterior surface to indicate the size of the cover, wherein the second indicator is repeatedly imprinted along the entire length of the elastic band, wherein the second indicator is a single word selected from a group of words consisting of "KING", "QUEEN", "FULL", and "TWIN"; and f. a third indicator affixed to the top panel exterior surface to indicate the size and orientation of the cover, wherein the third indicator is affixed adjacent to at least one corner of the top panel exterior surface, wherein the third indicator is a single letter selected from a group of letters consisting of "K", "Q", "F", and "T";

g. wherein the second indicator and third indicator are color coded to indicate the size of the cover, wherein the color codes are selected from the group of colors consisting of red, blue, green, and gray, wherein red indicates King size, blue indicates Queen size, green indicates Full size, and gray indicates Twin size.

9. A cover for a mattress according to claim 8, wherein the third indicator is affixed to the upper left corner and the lower right corner.

10. A method of sorting mattress covers having different sizes, comprising the steps of:

a. providing a plurality of mattress covers, wherein each mattress cover comprises:

i. a rectangular top panel having an exterior surface, an upper end, a lower end, a left side, a right side, an upper left corner formed at a junction between the top panel upper end and the top panel left side, an upper right corner formed at a junction between the top panel upper end and the top panel right side, a lower left corner formed at the junction between the top panel lower end and the top panel left side, and a lower right corner formed at the junction between the top panel lower end and the top panel right side;

ii. a skirt having a top end, a bottom end, and an exterior surface, wherein the skirt top end is continuously affixed to the top panel along the entire perimeter of the top panel;

iii. an elastic band having a top end, a bottom end, and an exterior surface, wherein the elastic band top end is affixed to the skirt bottom end along the length of the skirt bottom end;

iv. a first indicator embossed on the top panel exterior surface to indicate the size of the cover, wherein the first indicator is repeatedly embossed along the entire top panel exterior surface;

v. a second indicator imprinted on the elastic band exterior surface to indicate the size of the cover, wherein the second indicator is repeatedly imprinted along the entire length of the elastic band; and vi. a third indicator affixed to the top panel exterior surface to indicate the size and orientation of the cover, wherein the third indicator is affixed adjacent to at least one corner of the top panel exterior surface;

b. providing a plurality of laundry receptacles for receiving the plurality of mattress covers;

c. conveying dirty laundry past the plurality of laundry receptacles, wherein the dirty laundry includes a mixture of mattress covers;

d. sorting the dirty laundry according to size, wherein the step of sorting the dirty laundry includes the steps of:

i. removing any King size mattress covers from the dirty laundry using the first indicator and the second indicator, and placing the King size mattress covers into a laundry receptacle for receiving King size mattress covers;

ii. removing any Queen size mattress covers from the dirty laundry using the first indicator and the second indicator, and placing the Queen size mattress covers into a laundry receptacle for receiving Queen size mattress covers;

iii. removing any Full size mattress covers from the dirty laundry using the first indicator and the second indicator, and placing the Full size mattress covers into a laundry receptacle for receiving Full size mattress covers; and iv. removing any Twin size mattress covers from the dirty laundry using the first indicator and the second indicator, and placing the Twin size mattress covers into the laundry receptacle for receiving Twin size mattress covers.

11. A method according to claim 10, wherein the first indicator is a single word selected from a group of words consisting of "KING", "QUEEN", "FULL", and "TWIN".

12. A method according to claim 10, wherein the second indicator is a single word selected from a group of words consisting of "KING", "QUEEN", "FULL", and "TWIN".

13. A method according to claim 10, wherein the third indicator is a single letter selected from a group of letters consisting of "K", "Q", "F", and "T".

14. A method according to claim 10, wherein the third indicator is affixed adjacent to the upper left corner and the lower right corner.

15. A method according to claim 10, wherein the second indicator and third indicator are color coded to indicate the size of the cover, wherein the color codes are selected from the group of colors consisting of red, blue, green, and gray, wherein red indicates King size, blue indicates Queen size, green indicates Full size, and gray indicates Twin size.

16. A method of sorting mattress covers having different sizes, comprising the steps of:

a. providing a plurality of mattress covers, wherein each mattress cover comprises:

i. a rectangular top panel having an exterior surface, an upper end, a lower end, a left side, a right side, an upper left corner formed at a junction between the top panel upper end and the top panel left side, an upper right corner formed at a junction between the top panel upper end and the top panel right side, a lower left corner formed at the junction between the top panel lower end and the top panel left side, and a lower right corner formed at the junction between the top panel lower end and the top panel right side;

ii. a skirt having a top end, a bottom end, and an exterior surface, wherein the skirt top end is continuously affixed to the top panel along the entire perimeter of the top panel;

iii. an elastic band having a top end, a bottom end, and an exterior surface, wherein the elastic band top end is affixed to the skirt bottom end along the length of the skirt bottom end;

iv. a first indicator embossed on the top panel exterior surface to indicate the size of the cover, wherein the first indicator is repeatedly embossed along the entire top panel exterior surface, wherein the first indicator is a single word selected from a group of words consisting of "KING", "QUEEN", "FULL", and "TWIN";

v. a second indicator imprinted on the elastic band exterior surface to indicate the size of the cover, wherein the second indicator is repeatedly imprinted along the entire length of the elastic band, wherein the second indicator is a single word selected from a group of words consisting of "KING, "QUEEN", "FULL", and "TWIN"; and vi. a third indicator affixed to the top panel exterior surface to indicate the orientation of the cover, wherein the third indicator is affixed adjacent to at least one corner of the top panel exterior surface, wherein the third indicator is a single letter selected from a group of letters consisting of "K", "Q", "F", and "T";

vii, wherein the second indicator and third indicator are color coded to indicate the size of the cover, wherein the color codes are selected from the group of colors consisting of red, blue, green, and gray, wherein red indicates King size, blue indicates Queen size, green indicates Full size, and gray indicates Twin size;

b. providing a plurality of laundry receptacles for receiving the plurality of mattress covers, wherein the plurality of laundry receptacles includes a laundry receptacle for receiving King size mattress covers, a laundry receptacle for receiving Queen size mattress covers, a laundry receptacle for receiving Full size mattress covers, and a laundry receptacle for receiving Twin size mattress covers;

c. conveying dirty laundry past the plurality of laundry receptacles, wherein the dirty laundry includes a mixture of mattress covers selected from the group consisting of King size mattress covers, Queen size mattress covers, Full size mattress covers, and Twin size mattress covers;

d. sorting the dirty laundry according to size, wherein the step of sorting the dirty laundry includes the steps of:

i. removing any King size mattress covers from the dirty laundry using the first indicator and the second indicator, and placing the King size mattress covers into the laundry receptacle for receiving King size mattress covers;

ii. removing any Queen size mattress covers from the dirty laundry using the first indicator and the second indicator, and placing the Queen size mattress covers into the laundry receptacle for receiving Queen size mattress covers;

iii. removing any Full size mattress covers from the dirty laundry using the first indicator and the second indicator, and placing the Full size mattress covers into the laundry receptacle for receiving Full size mattress covers; and iv. removing any Twin size mattress covers from the dirty laundry using the first indicator and the second indicator, and placing the Twin size mattress covers into the laundry receptacle for receiving Twin size mattress covers.

17. A method according to claim 16, wherein the third indicator is affixed adjacent to the upper left corner and the lower right corner.

* * * * *